US009878253B2

(12) United States Patent
Fisher

(10) Patent No.: US 9,878,253 B2
(45) Date of Patent: Jan. 30, 2018

(54) FRICTION REDUCING WATERSLIDE SECTION

(71) Applicant: Skyturtle Technologies Ltd., Enderby (CA)

(72) Inventor: Lance Fisher, Enderby (CA)

( * ) Notice: Subject to any disclaimer, the term of this patent is extended or adjusted under 35 U.S.C. 154(b) by 232 days.

(21) Appl. No.: 14/766,283

(22) PCT Filed: Feb. 6, 2014

(86) PCT No.: PCT/CA2014/050079
§ 371 (c)(1),
(2) Date: Aug. 6, 2015

(87) PCT Pub. No.: WO2014/121395
PCT Pub. Date: Aug. 14, 2014

(65) Prior Publication Data

US 2015/0367241 A1 Dec. 24, 2015

Related U.S. Application Data

(60) Provisional application No. 61/761,352, filed on Feb. 6, 2013.

(51) Int. Cl.
*A63G 21/18* (2006.01)
*B61B 13/12* (2006.01)

(52) U.S. Cl.
CPC ..... *A63G 21/18* (2013.01); *B61B 13/12* (2013.01)

(58) Field of Classification Search
CPC ..... A63G 21/18; A63G 21/08; A63G 21/14; A63G 21/02; A63G 3/00; A63G 21/00; A63G 3/02; B61B 13/12; B61B 13/122; B61B 13/127; B61B 13/08; B60L 13/03
See application file for complete search history.

(56) References Cited

U.S. PATENT DOCUMENTS

| | | | | |
|---|---|---|---|---|
| 5,860,364 | A | 1/1999 | McKoy | |
| 6,729,963 | B2 * | 5/2004 | Hlynka | A63G 21/18 472/117 |
| 8,162,769 | B2 | 4/2012 | Henry | |
| 2007/0207869 | A1 * | 9/2007 | Hunter | A63G 3/02 472/117 |

FOREIGN PATENT DOCUMENTS

| | | | |
|---|---|---|---|
| CA | 2654714 | | 10/2012 |
| GB | 5544 | * | 0/1910 |

OTHER PUBLICATIONS

International Searching Authority, ISR, PCTCA2014050079, dated Apr. 28, 2014, 8 pages.

* cited by examiner

*Primary Examiner* — Mark T Le
(74) *Attorney, Agent, or Firm* — Schacht Law Office, Inc.; Dwayne Rogge

(57) ABSTRACT

An apparatus and method for transporting a rider wherein the apparatus comprises a vehicle having a bottom sliding surface and an interior sized to receive at least one rider. Also described is a track having a path sized to receive the vehicle therein, at least one sliding section disposed along the track, and at least one roller section disposed along the track. The method comprises locating a vehicle within the track and conveying said vehicle along the sliding and rolling sections.

10 Claims, 7 Drawing Sheets

FRICTION REDUCING WATERSLIDE SECTION

RELATED APPLICATIONS

This applic0ation is a national phase entry of PCT Application PCT/CA2014/050079, filed Feb. 6, 2014, incorporated herein by reference. PCT application PCT/CA2014/050079 claims priority from U.S. Provisional Patent Application No. 61/761,352 filed Feb. 6, 2013 entitled FRICTION REDUCING WATERSLIDE SECTION.

BACKGROUND OF THE DISCLOSURE

Field of the Disclosure

This disclosure relates to waterslides in general and in particular to a method and apparatus for reducing the friction of a vehicle within a waterslide.

Background Art

Water slides are a common and popular recreational activity. Waterslides commonly comprise a track formed of a tubular or contoured track, with a flow of water traveling from the top to the bottom to convey a rider.

Conventional waterslides rely completely on gravity and flowing water to convey the rider to the bottom of the slide. Such conventional waterslides use only potential energy gained from climbing a tower to move the vehicle down the waterslide. Using only potential energy creates the disadvantages of not being able to start motion on a flat section (launching) and not being able to climb to a height greater than the proceeding drop.

An alternative method of propelling a rider along the waterslide involves located the rider within a vehicle or raft, and propelling the vehicle along the waterslide through the use of linear induction motors.

Such linear induction motors often rely upon a metal plate located within the vehicle which is acted upon by successive magnetic coils located within a track portion of the waterslide.

Such linear induction motors may be prone to drawing the vehicle downward towards the track under the influence of the magnetic coils which will produce friction between the vehicle and the track thereby impeding movement.

BRIEF SUMMARY OF THE DISCLOSURE

According to one example of the disclosure provides an apparatus for transporting a rider comprising a vehicle having a bottom sliding surface and an interior sized to receive at least one rider, a track having a path sized to receive the vehicle therein, at least one sliding section disposed along the track and at least one roller section disposed along the track.

The roller section may include a drive for propelling the vehicle along the track. The drive may comprise a linear induction drive. The vehicle may include a metal plate along the bottom thereof. The metal plate may be embedded within the vehicle.

The roller section may include a plurality of rollers disposed therealong to support the vehicle. The rollers may be unidirectionally aligned to rotate about an axis perpendicular to a desired motion of the vehicle. The rollers may be pivotally mounted to the roller section so as to be unidirectional. The rollers may be located within cavities along a top surface of the roller section. The rollers may be located on top of a top surface of the roller section. The track may be substantially impermeable.

According to a further example of the disclosed apparatus there is disclosed a method for transporting a rider comprising providing a track having a path sized to receive a vehicle therein, locating the vehicle having a bottom sliding surface and an interior sized to receive at least one rider within the track, conveying the vehicle along at least one sliding section disposed along the track and conveying the vehicle along at least one roller section disposed along the track. Other aspects and features of the disclosed apparatus will become apparent to those ordinarily skilled in the art upon review of the following description of specific embodiments in conjunction with the accompanying figures.

BRIEF DESCRIPTION OF THE SEVERAL VIEWS OF THE DRAWINGS

In drawings which illustrate examples wherein similar characters of reference denote corresponding parts in each view.

DETAILED DESCRIPTION OF THE DISCLOSURE

Figure 1:
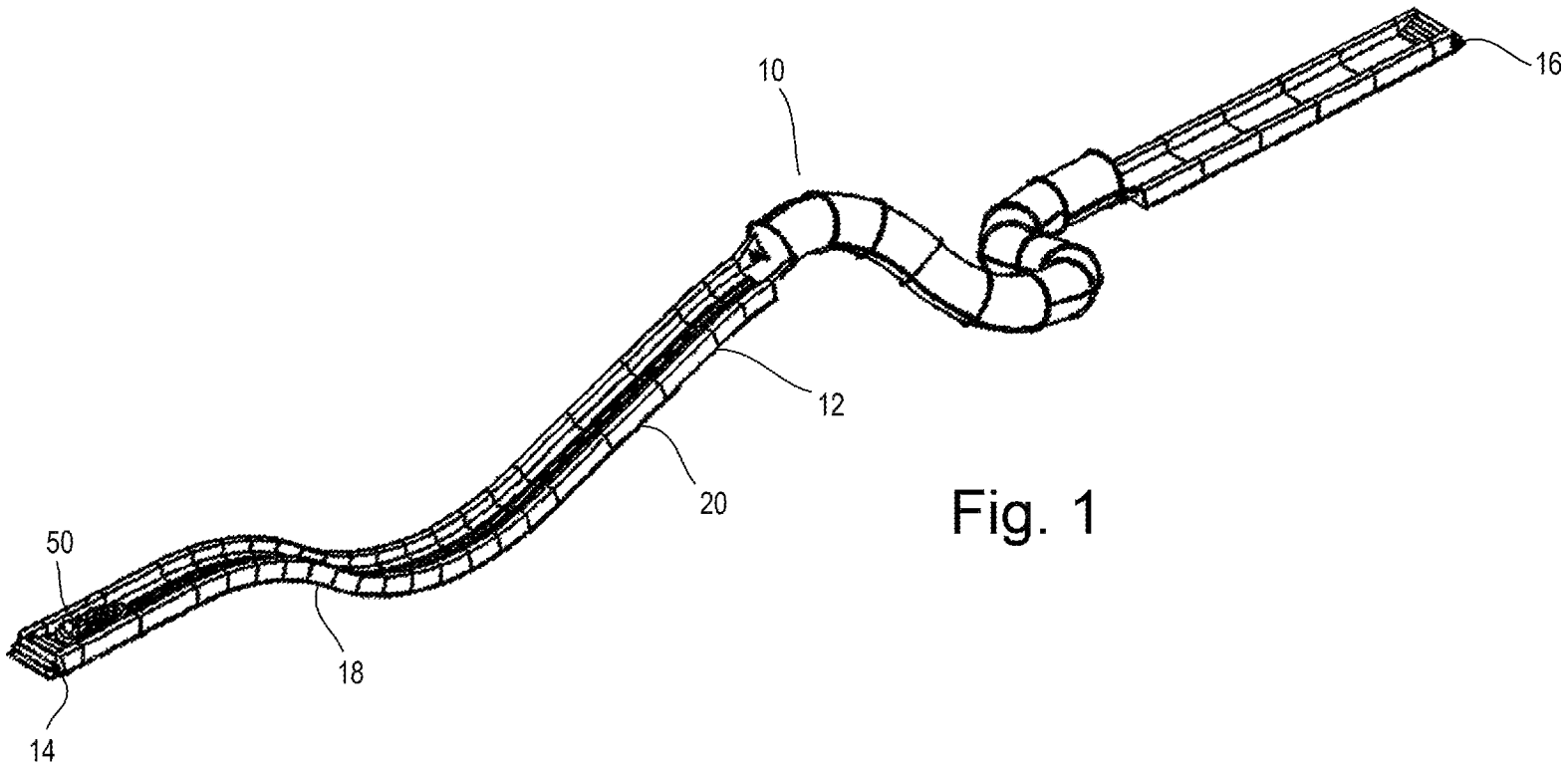
FIG. 1 is a perspective view of a waterslide according to one example of the disclosed apparatus.
Figure 2:
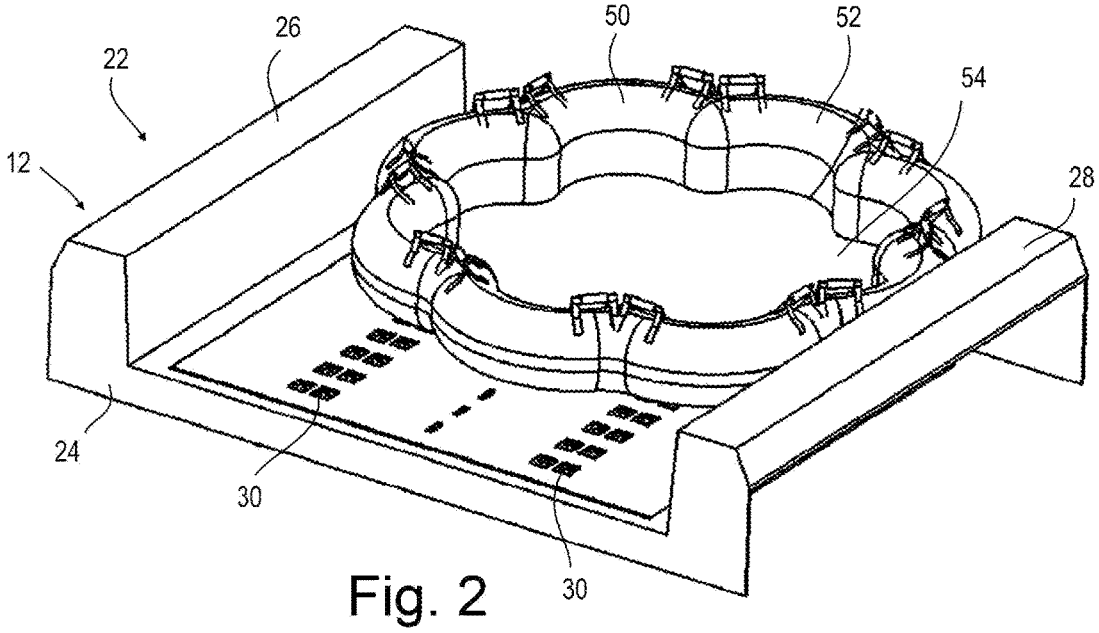
FIG. 2 is a perspective view of a rolling section of the waterslide track of FIG. 1.
Figure 6:
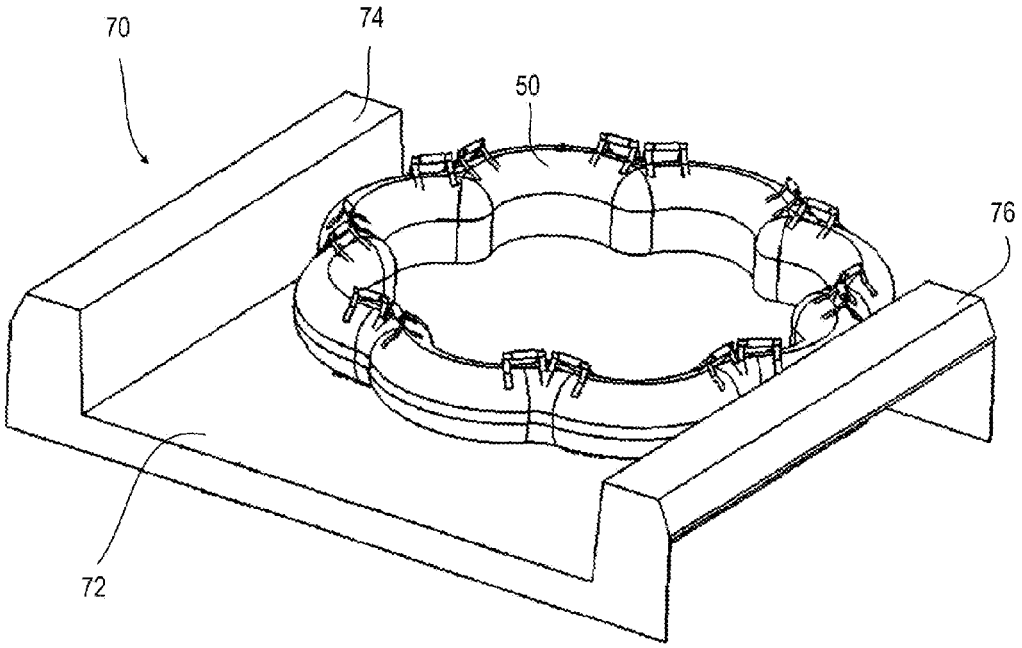
FIG. 6 is a perspective view of a sliding section of the waterslide track of FIG. 1.

Referring to FIG. 1, a waterslide according to one example of the disclosure is shown generally at 10. The water slide 10 comprises an elongate track 12 having a beginning 14 and a finish 16. The track 12 may optionally include one or more downhill portions 18 and one or more uphill portions 20. Although both downhill 18 and uphill 20 portions are illustrated in FIG. 1, it will be appreciated that any combination of uphill, downhill, level and turning portions may be combined for the desired ride. As illustrated in FIG. 1, the track 12 includes at least one vehicle 50 operable to be received within the track and propelled therealong as will be more fully described below. As illustrated in FIGS. 2 and 6, the track 12 may be formed of a plurality of sections comprising sliding sections 70 and roller sections, 22, which will be further described below. Turning now to FIG. 2, a roller section 22 of the track is illustrated. The track comprises a bottom surface 24, and first and second side walls, 26 and 28, respectively. The bottom surface 24 includes a plurality of rollers 30 for supporting the vehicle 50 within the track 12 while the first and second side walls 26 and 28 contain the vehicle laterally to remain upon the track 12. Although one example of the track 12 is illustrated in FIG. 2 as having a substantially rectangular cross-section, it will be appreciated that other cross-sections may also be utilized, such as, by way of non-limiting example, circular, oval or irregular. It will furthermore be appreciated that for non-rectangular cross-sections the bottom surface 24 and side walls 26/28 may be blended together so as to not form distinct corners therebetween.

Figure 3:
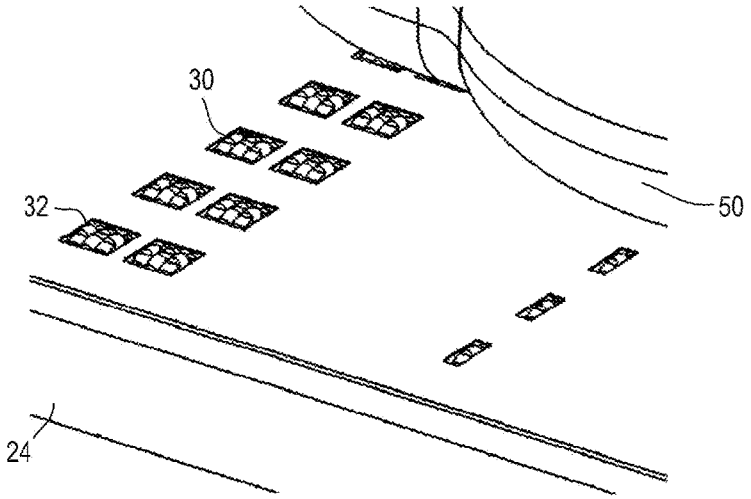
FIG. 3 is a detailed perspective view of the rolling section of FIG. 2.
Figure 4:
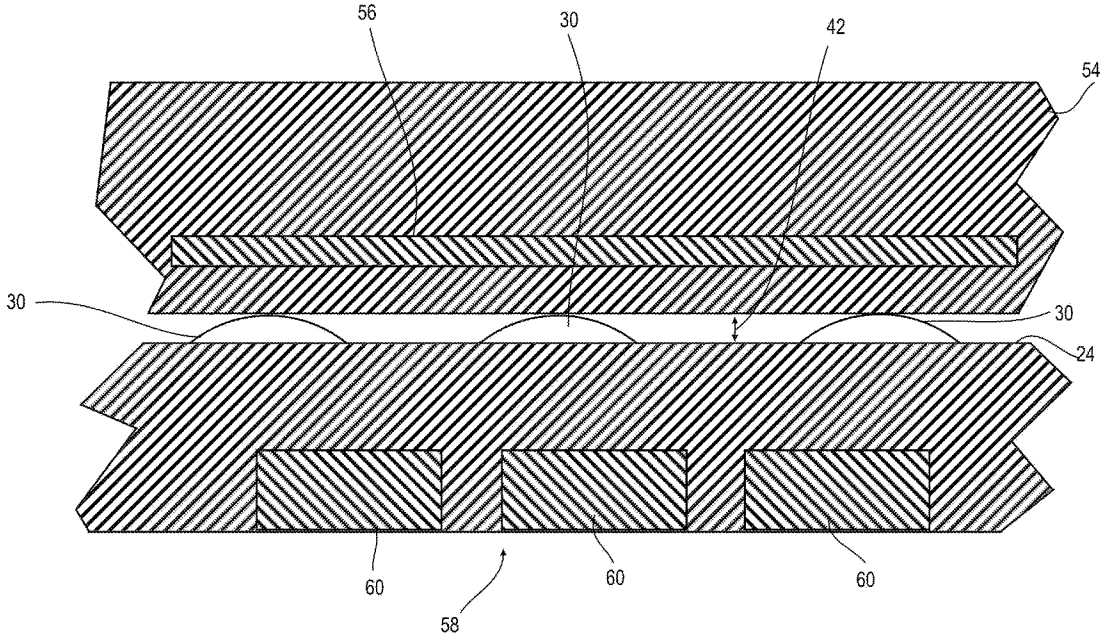
FIG. 4 is a highly schematic side view of the rolling section of FIG. 2 with the vehicle therein.

As illustrated in FIGS. 2 and 6, one example of a vehicle for use in the track 12 is shown generally at 50. The vehicle 50 of this example comprises an outer wall 52 which may be formed of an inflatable body as is commonly known in the art. The vehicle 50 in this example includes a bottom panel 54 which provides a surface for occupants to sit upon within the outer wall 52. As illustrated in FIG. 4 the bottom panel 54 may include a conductive plate 56 therein. The conductive plate 56 may be formed of any conductive material, such as, by way of non-limiting example, aluminum, steel, stainless steel or the like. It will also be appreciated that the conductive plate 56 may be formed of a continuous uniform member or may optionally be formed of a plurality of members, windings, or coils. The bottom surface 24 of the roller section 22 in this example includes a plurality of rollers 30 located therealong. As illustrated in FIGS. 2 and 3, the rollers 30 may be located within cavities 32 disposed in the bottom surface 24.

Figure 5:
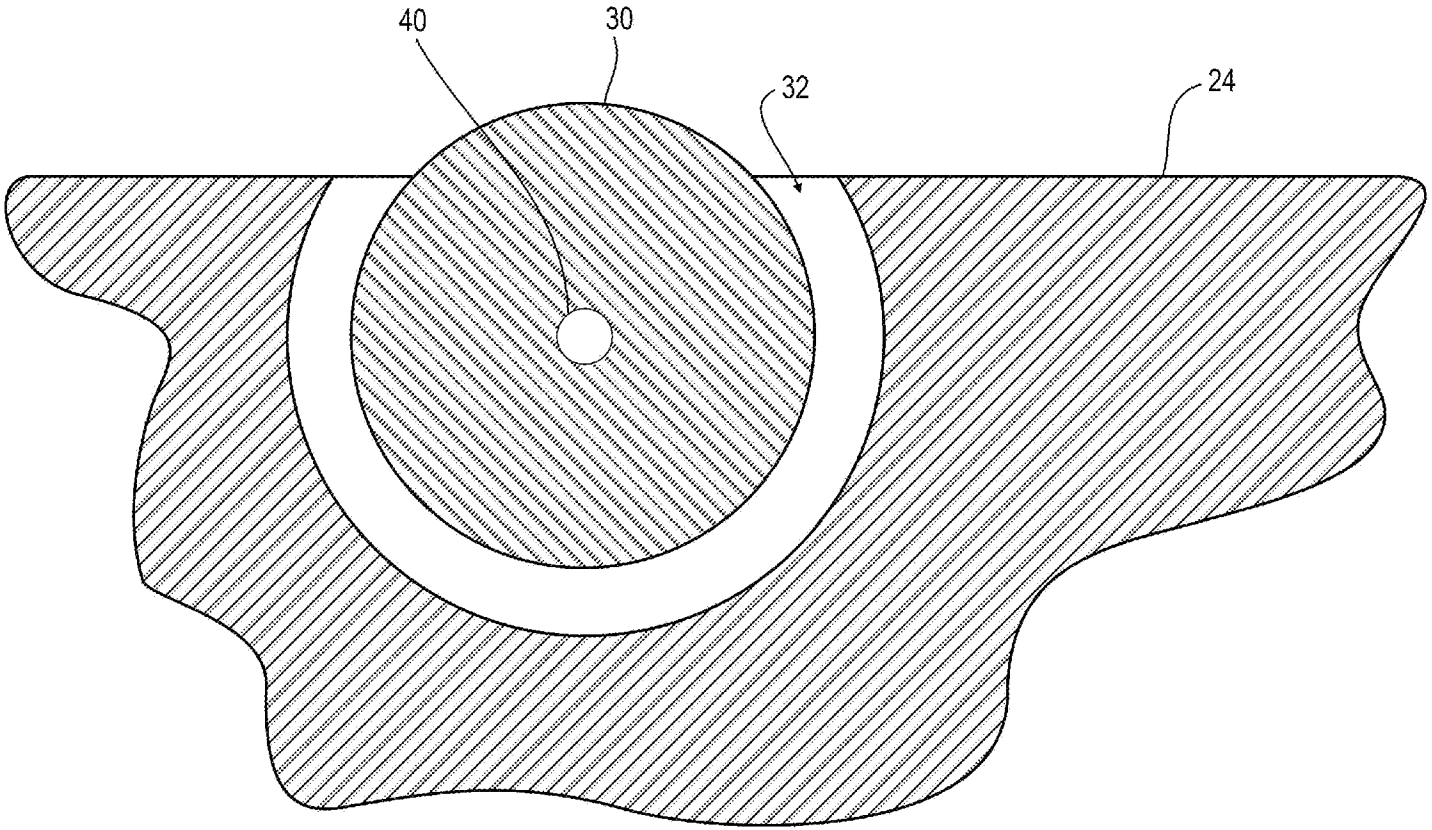
FIG. 5 is a highly schematic cross sectional view of one of the rollers located within the rolling section of FIG. 2.
Figure 8:
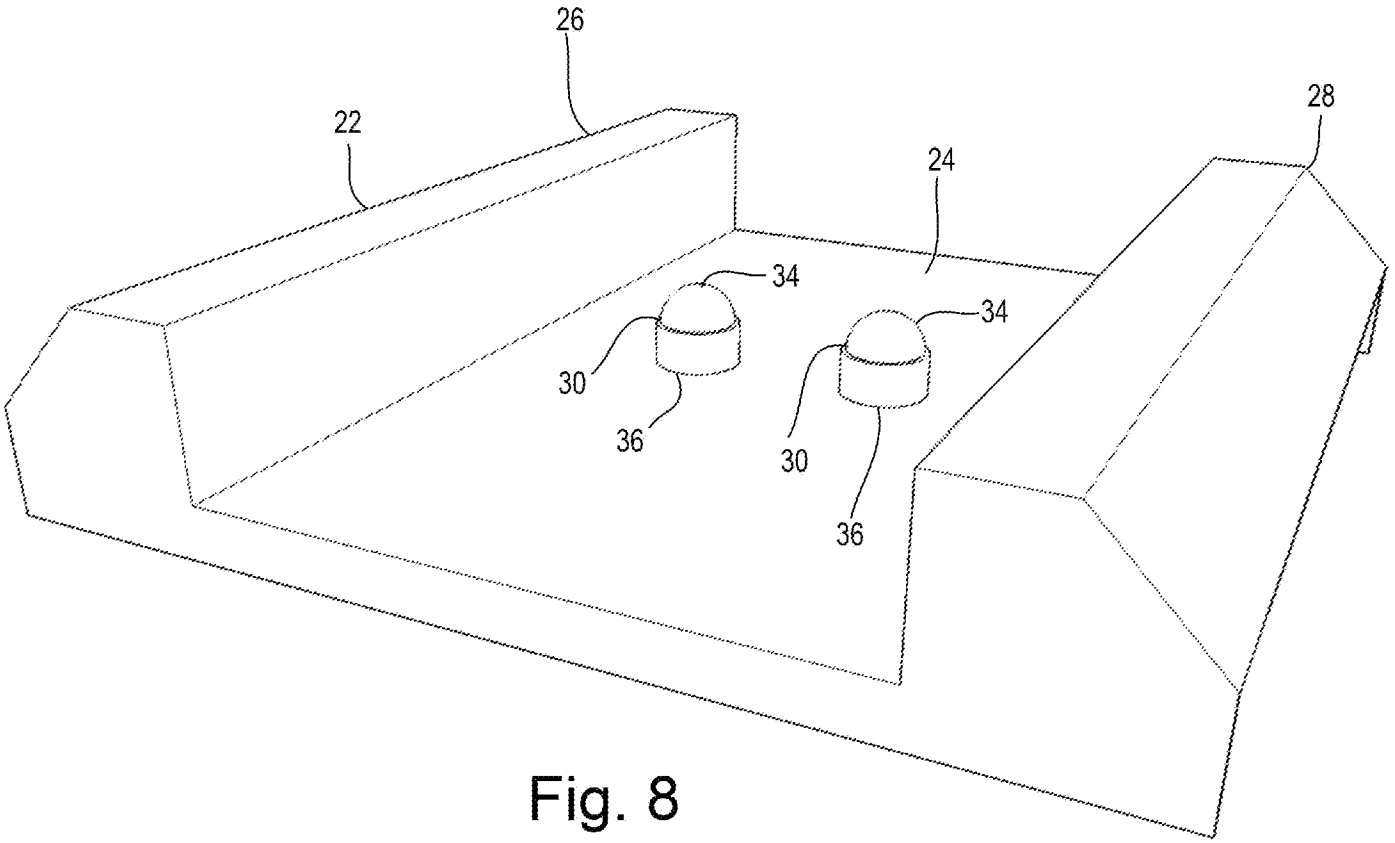
FIG. 8 is a perspective view of a rolling section of the waterslide of FIG. 1.

Optionally, the rollers 30 may be located above the bottom surface 24 within pods 36 as illustrated by way of example in FIG. 8. The rollers 30 may be unidirectional so as to rotate about a pin 40 as illustrated in FIG. 5 such that the roller has an axis of rotation about the pin 40 perpendicular to the path of travel of the vehicle 50.

As illustrated in FIG. 8, the roller 30 may also comprise a sphere 34 contained within the cavity 32 in either the pod 36 or the bottom surface so as to be operable to rotate in any direction (multidirectional) thereby permitting movement of the vehicle 50 in any direction. It will be appreciated that in one example the cavities 32 are sealed to prevent the escape of water from the track 12.

Referring to FIG. 4, the rollers 30 space the bottom panel 54 of the vehicle above the bottom surface 24 of the track by a spacing distance generally indicated at 42. The spacing distance 42 is selected to permit water to flow between the bottom panel 54 of the vehicle and the bottom surface 24 while maintaining the conductive plate 56 in proximity to the linear induction drive 58 as will be discussed below. In practice it has been found that in one example a spacing distance of between 0.075 and 1 inches (2 and 25 mm) has been useful.

The roller section 22 may optionally include a linear induction drive 58 as illustrated in FIG. 4 wherein a plurality of electromagnets 60 are located within or below the bottom surface 24 of the track 12. The electromagnets 60 act on and propel the plate 56 in the vehicle 50 in a desired direction according to commonly known methods. As illustrated in FIG. 4, the use of rollers 30 below the vehicle while the electromagnets 60 are operating on the vehicle 50 prevent the vehicle 50 from being drawn downward under influence of the electromagnets 60 to frictionally engage with the bottom surface 24 of the track thereby impeding movement of the vehicle.

Figure 7:
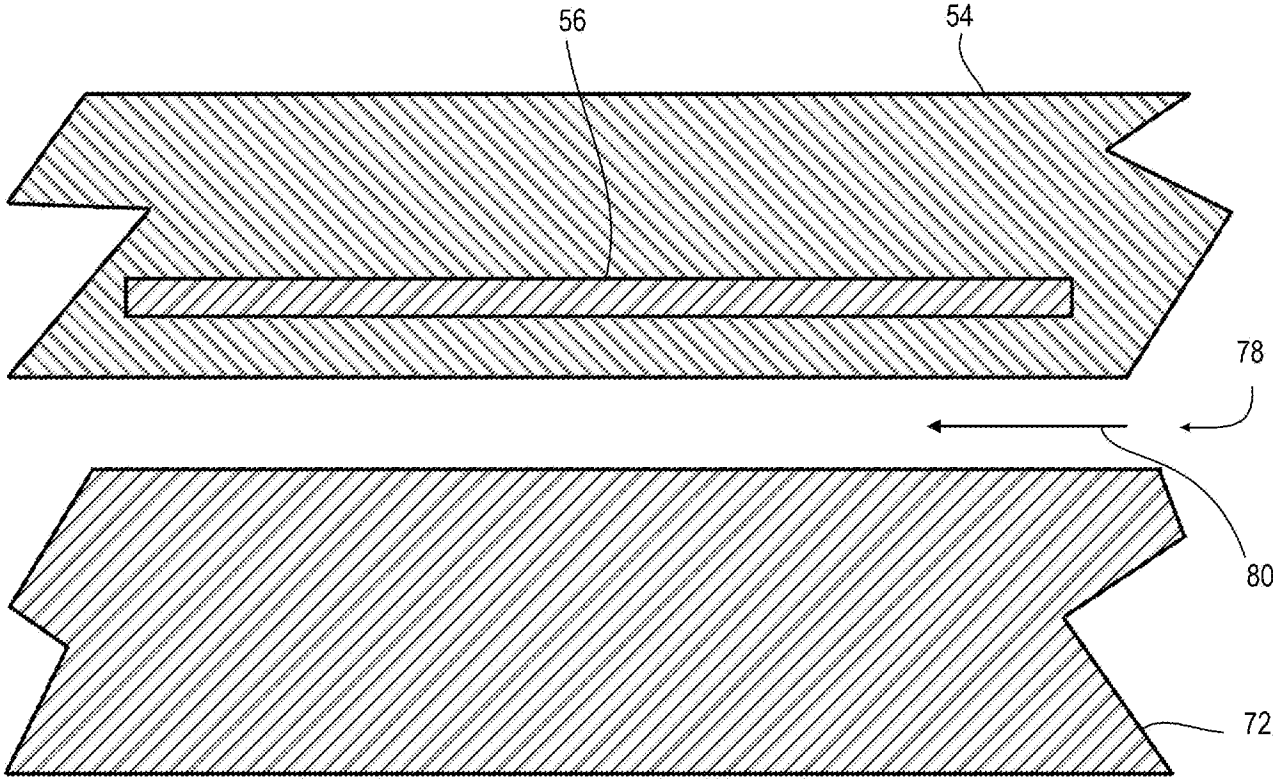
FIG. 7 is a highly schematic side view of the sliding section of FIG. 6 with the vehicle therein.

Turning now to FIG. 6, one example of a sliding section 70 of the track 12 is illustrated. The sliding section 70 comprises a bottom surface 72, and first and second side walls, 74 and 76, respectively. The bottom surface 72 may be substantially flat or unobstructed to permit water and the vehicle 50 to slidably translate thereover. It will be appreciated that the sliding section 70 in one example will have a cross section corresponding to the roller section 22 so as to accommodate vehicles 50 of a common size therethrough. As illustrated in FIG. 7 the bottom surface 72 of the sliding section 70 is shaped to permit water to flow thereon so as to provide a cushion of water, generally indicated at 78 to flow between the bottom surface 72 of the track and the bottom panel 54 of the vehicle 50 in a direction generally indicated at 80. In operation, the waterslide 10 may be formed of a plurality of roller sections 22 and sliding sections 70 to form an elongate path of travel for the waterslide 10. The sliding sections 70 may be located on downhill portions 18 of the waterslide 10 while the roller sections 22 with linear induction motors may be provided at uphill portions 20 or at other locations where the vehicle 50 is required to be propelled. A continuous flow of water 78 may be provided along the waterslide 10 to carry the vehicle 50 along the sliding sections 70 according to known methods.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

What is claimed is:

1. A waterslide for transporting a rider comprising:

a vehicle having a bottom surface, an outer wall, and an interior sized to receive at least one rider;

a track sized to receive said vehicle therein;

at least one sliding section disposed along said track;

at least one roller section having rollers disposed along said track to support said vehicle;

wherein said roller section includes a drive motor for propelling said vehicle along said track;

wherein the drive motor propels said vehicle simultaneously with the rollers supporting said vehicle;

wherein said drive motor comprises a linear induction motor (LIM) having a plurality of electromagnets; and wherein the electromagnets are located within or below a bottom surface of the track, and the rollers are located at least partially below the bottom surface of the track.

2. The waterslide of claim 1 wherein said vehicle includes a conductive plate along said bottom thereof cooperating with the linear induction motor.

3. The waterslide of claim 2 wherein said conductive plate is embedded within said vehicle.

4. The waterslide of claim 1 wherein said rollers are unidirectionally aligned to rotate about axes perpendicular to a desired motion of said vehicle.

5. The waterslide of claim 1 wherein said rollers are pivotally mounted to said roller section so as to be unidirectional.

6. The waterslide of claim 1 wherein said rollers are located within cavities along a top surface of said roller section.

7. The waterslide of claim 1 wherein said rollers are located vertically above the linear induction motor of said roller section.

8. The waterslide of claim 1 wherein said track is substantially impermeable.

9. A method of operating the waterslide of claim 1, comprising the steps of:

conveying said vehicle along the at least one sliding section disposed along said track; and conveying said vehicle along the at least one roller section disposed along said track.

10. A waterslide for transporting a rider comprising:

a vehicle having a bottom surface, an outer wall, and an interior sized to receive at least one rider;

wherein said vehicle includes a metal plate along said bottom thereof;

wherein said metal plate is embedded within said vehicle a track sized to receive said vehicle therein;

at least one roller section disposed along said track;

a plurality of rollers on the roller section configured to engage the bottom surface of the vehicle;

wherein said roller section includes a drive for propelling said vehicle along said track independent of the rollers;

wherein said drive comprises a linear induction motor;

the linear induction motor including electromagnets coupled to the track;

at least one sliding section disposed along said track; and wherein the electromagnets are located within or below a bottom surface of the track, and the rollers are located at least partially below the bottom surface of the track.

* * * * *